US006382851B2

(12) United States Patent
Fujiwara

(10) Patent No.: US 6,382,851 B2
(45) **Date of Patent: *May 7, 2002**

(54) PRINTER

(75) Inventor: Hitoshi Fujiwara, Shiojiri (JP)

(73) Assignees: F&F Limited, Nagano; Seiko Instruments, Inc., Chiba, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/195,430

(22) Filed: Nov. 18, 1998

(30) Foreign Application Priority Data

Nov. 21, 1997 (JP) ..... 9-320670

(51) Int. Cl.[7] ..... B41J 2/315
(52) U.S. Cl. ..... 400/120.01; 400/625
(58) Field of Search ..... 400/120.01, 124.12, 400/124.11, 120.05, 120.17, 625; 101/487, 488

(56) References Cited

U.S. PATENT DOCUMENTS 4,727,391 A * 2/1988 Tajima et al. ..... 354/277
5,248,207 A * 9/1993 Yamamoto ..... 400/120
5,276,527 A * 1/1994 Sugiyama et al. ..... 358/296
5,426,496 A * 6/1995 Koike et al. ..... 355/309
5,733,052 A * 3/1998 Suzuki ..... 400/120.01
5,787,323 A * 7/1998 Nomura et al. ..... 399/111
5,876,129 A * 3/1999 Suzuki ..... 400/120.01

* cited by examiner

*Primary Examiner*—John S. Hilten
*Assistant Examiner*—Darius N. Cone
(74) *Attorney, Agent, or Firm*—Blank Rome Comisky & McCauley LLP

(57) ABSTRACT

A printer includes a flat case having a flat top surface in which a printing mechanism and a sheet storage portion capable of accommodating a plurality of printing sheets are housed to be arranged along the top surface such that the printed sheet is fed out through an exit slot formed in the top surface. With such an arrangement, a thin printer can be achieved. In addition, the printed sheet fed out through the exit slot onto the flat top surface can be used just like a scratch pad or a notebook while being placed thereon. Moreover, the printer is of a thermal-type using thermal sheets, leading to reduced number of components. Therefore a compact printer can be achieved. Furthermore the printer uses thermal sheets of standard size such as A6 or B7. Accordingly, the printer can be formed to have a size substantially the same as that of a small notebook. A printer that can be handled like stationery, thus, can be obtained.

15 Claims, 4 Drawing Sheets

(a)

(b)

PRINTER

BACKGROUND OF THE INVENTION

1. Technical Field

The present invention relates to a printer for printing characters and/or graphic images on a printing sheet and, more particularly, to the printer which saves the desktop space.

2. Description of the Related Art

Accompanied with recent trend of popularized multimedia, in particular, personal computers that have been widely used not only for the office but also for home, the printer, one of peripheral devices for the personal computer, has been increasingly used as the output device. In conjunction with wide use of the personal computers, the printer has been used for various purposes to satisfy various demands.

As the printers have been remarkably improved in terms of colorization, high resolution, multi-function, high operation speed and quality, the use of large-sized and expensive printers have become mainstream. Therefore the aforementioned high-performance, multi-functional printer has been shared by a plurality of users through a network or the like.

Meanwhile a printer for personal use has still been highly demanded. As it is often the case that the printer linked with a plurality of personal computers is not located close to users, they have to get out of their seat to take the print output from the printer. Moreover, since the printer is shared by a plurality of users, the printing result can not be obtained immediately. Thus, each user cannot use the printer as freely as desired, resulting in deteriorated operating efficiency on a personal level. As a result, it may be difficult to print small-sized data such as personal memos on demand.

Compact printers providing high-quality printing have been commercially available for individual users. However, the printing sheet of size A4 or larger are used for such compact printers as in the case of the printer shared by users. Furthermore most of the printers which have been currently in wide use are laser printers or ink-jet printers. The above-type printer incorporates a large number of components, thus unavoidably enlarging the assembly size. Therefore it is difficult to further realize size reduction. For this, relatively a large and level space for the printer has to be reserved in addition to the space for the personal computer.

When users want to print the image, e-mail or the like instantly, most of them may feel reluctance to use the printer which occupies the space as large as that for the personal computer to narrow the desktop space in the office or home. Meanwhile, general personal use printers in the market are provided with multi-functions, and therefore, are expensive and not affordable.

It is therefore an object of the present invention to provide an inexpensive printer which occupies only a small desktop space. It is another object of the present invention to provide a printer which can be readily used by an individual user just like scratching a few lines on a memo pad.

SUMMARY OF THE INVENTION

A printer according to the present invention includes a flat case having substantially a flat top surface in which a printing mechanism and a sheet storage portion capable of accommodating a plurality of printing sheets of standardized size are housed so as to be arranged along the top surface of the case. The printer further includes an exit slot formed in the top surface of the case for feeding out the printed sheet. In the printer of the present invention, the sheet storage portion and the printing mechanism are arranged so as almost not to be overlapped with each other, resulting in substantially a thin printer as a whole. The printed sheet is fed out onto the flat top surface of the case such that the resultant print on the thin and compact printer can be used as a memo/scratch pad or a notebook.

The printer of the present invention has various advantages as described below. That is, the printing mechanism incorporates a pick-up roller capable of picking up a thermal printing sheet from the sheet storage portion, a platen roller capable of feeding the thermal sheet, and a thermal head capable of printing on the thermal sheet. Therefore unlike ink jet printers, the printer of the present invention requires no expendable supplies such as toner or ink. Accordingly this printer can save the space for accommodating such expendable or consumable supplies, leading to the small and thin printing mechanism. As a result, the case incorporating the printing mechanism and the sheet storage portion can be formed into substantially a very thin structure. As the thermal sheet is thin, the sheet feeding direction can be readily changed. Therefore the platen roller having a small diameter can be used to allow an arrangement of the path on which the sheet is fed out from the top surface even in a limited space. Furthermore, the use of the thermal sheet may eliminate the need and space for replacement of the expendable supplies.

Moreover, the printer of the present invention uses the printing sheet of standardized size, which has been cut into a given size in place of the roll-type paper. Accordingly, the printing sheet can be accommodated in the thinner sheet storage portion as compared with that of the printer using the roll-type paper. This makes it possible to form the case into substantially a thin structure. In other words, unlike the conventional compact thermal-type printers using roll-type thermal paper, the printer of the present invention uses cut thermal sheets of standard size. Therefore, the printer of the present invention can be formed into a very thin and compact structure. Moreover, according to the printer of the present invention, printing sheet is fed piece by piece. Therefore, a sheet feeding mechanism does not have to be accurate as that of the conventional compact printer using the roll-type paper. As a result, the present invention realizes an inexpensive, highly reliable printer which hardly causes paper jam.

Moreover, since the printed sheet is fed out onto the top surface, the flat top surface of the case can be utilized as a tray on which the fed printed sheet is placed. The printer feeds out the printed sheet with its printed surface upside such that the user can confirm the printing result immediately. Then the user is allowed to scratch a few lines on the fed print placed on the top flat surface of the printer just like writing down memos on the notebook. As described above, the printer of the present invention using the thermal sheet can be formed into a thin structure as a desktop printer just like a notebook or a memo pad.

The sheet storage portion has a size suitable for accommodating the printing sheet of size A6 or B7, which can form the printer to be as small as a memo pad or a pencil case, thus saving the desktop space.

In the printer of the present invention, the print is fed out onto the top surface of the case, which will not allow any device to be placed thereon. As a result, at least a part of the top surface of the case can be opened and closed as a cover of the sheet storage portion, thus allowing easy supply of the printing sheets.

BRIEF DESCRIPTION OF THE DRAWINGS

The aforementioned and other objects and advantages of the present invention will become apparent to those skilled in the art upon reading and understanding the following detailed description with reference to the accompanying drawings.

In the drawings.

DESCRIPTION OF THE PREFERRED EMBODIMENT

Figure 1:
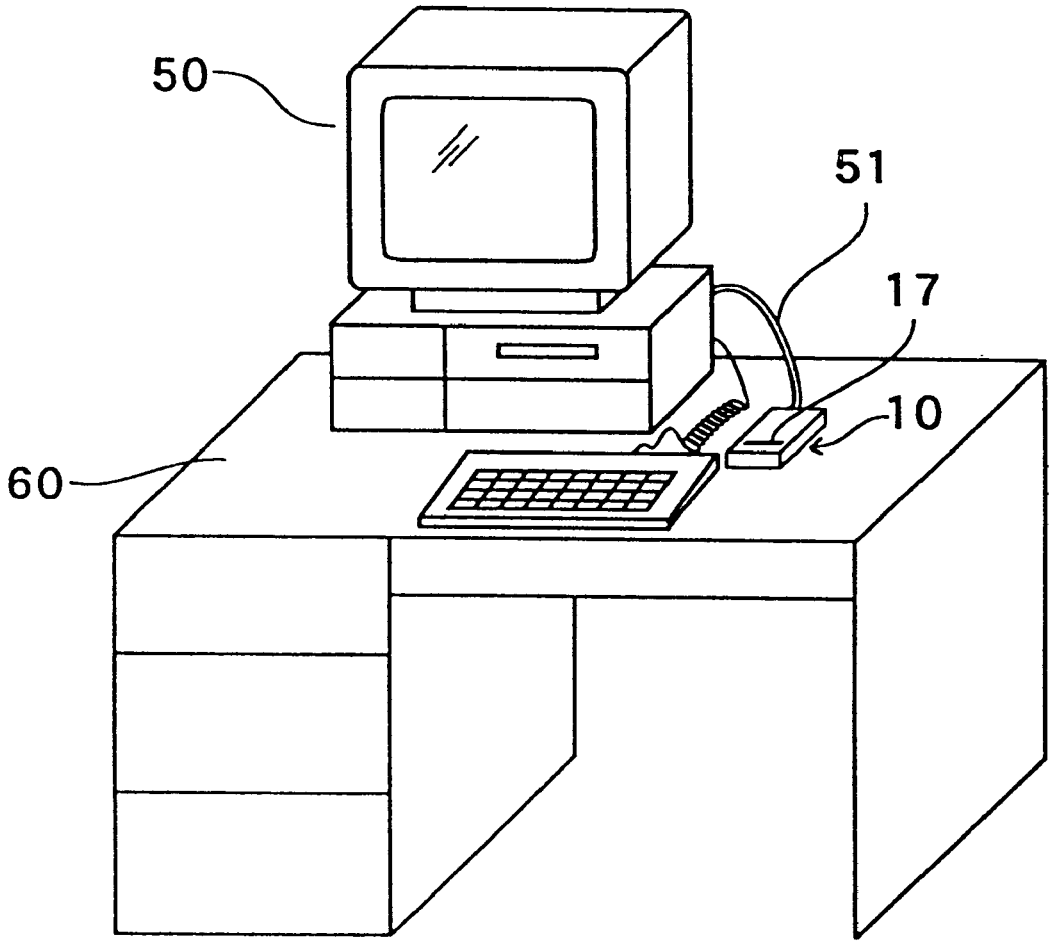
FIG. 1 is a perspective view of a printer according to the present invention which is connected to a personal computer together with other peripheral devices.

Hereinafter, an embodiment of the present invention will be described with reference to the accompanying drawings. A printer 10 of the present embodiment can be formed to have substantially the same size as that of a small notebook or a pencil case. Therefore, as shown in FIG. 1, the printer 10 can be placed on, for example, a desk 60 set aside the data processor such as a notebook-sized personal computer or a desk-top personal computer (a desk-top personal computer 50 is shown in FIG. 1). As a result, the space required for the printer 10 can be substantially reduced. The printer 10 of the present embodiment is connected to the personal computer 50 through a printer cable 51, an infrared interface or the like such that the printer 10 performs printing of data transmitted from the computer 50.

Figure 2:
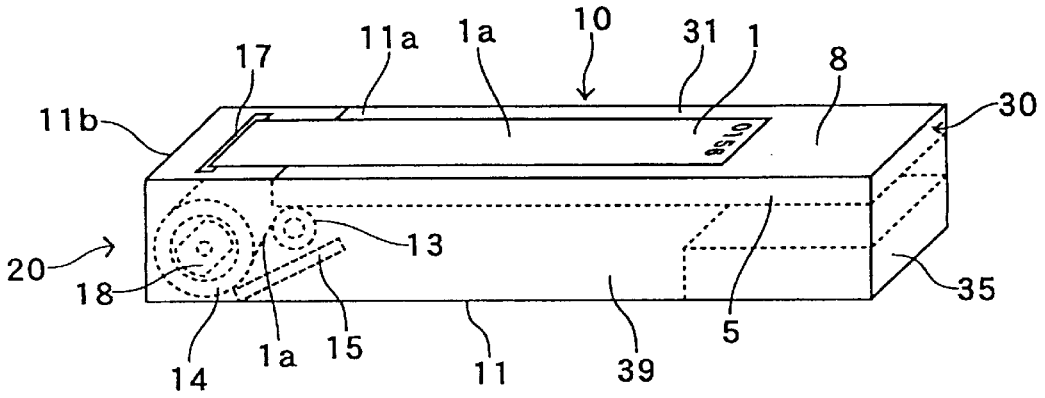
FIG. 2 is a schematic diagram of the printer shown in FIG. 1.

FIG. 2 schematically shows the printer 10 of the present embodiment. The printer 10 of the present embodiment includes a thin case 11 molded from a material such as plastic and having a flat top surface 11*a*. A printing mechanism 20 and a sheet storage portion 30 are arranged in the case 11 along the top surface 11*a* so as not to be substantially overlapped with each other. Thus, the case 11 of the printer 10 has a thin body with a rectangular-shaped top surface 11*a*. An exit slot 17 for feeding out the printed sheet 1 is provided in the vicinity of one shorter side, i.e., the side 11*b*, of the rectangular top surface 11*a*. The exit slot 17 extends along the side 11*b*, that is, in the direction perpendicular to the longitudinal direction of the top surface 11*a*. Therefore, the printed sheet 1 is fed out through the exit slot 17 onto the top surface 11*a* of the case 11 serving as a tray 31 on which the fed print is placed. Moreover, the printing sheet 1 is fed out onto the top surface 11*a* with its printed surface 1*a* directed upside (face up) such that the user is allowed to confirm the printing result immediately. Furthermore, as the top surface 11*a* of the case 11 is flat, the user is also allowed to directly write down memos on the fed print 1 placed on the top surface 11*a* just like using the notebook or scratch pad.

Figure 3:
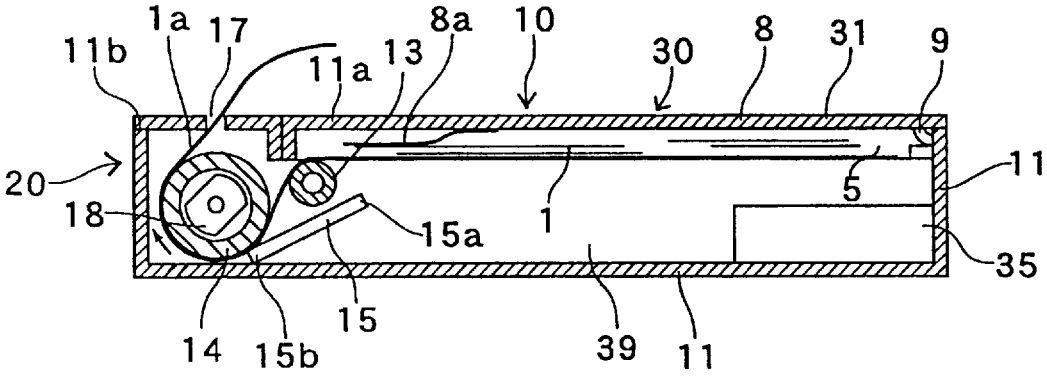
FIG. 3 is a schematic cross sectional view of the printer shown in FIG. 1.

FIG. 3 is a schematic cross sectional view of a structure of the printer 10 of the present embodiment. The printing portion 20 is located below the exit slot 17 along the short side 11*b* of the case 11 in the vicinity thereof. The sheet storage portion 30 is located adjacent to the position where the printing mechanism 20 and a portion for picking up the sheet 1 are partially overlapped. The sheet storage portion 30 includes a space 5 for accommodating a plurality of thermal sheets 1 of standardized size. The space 5 is located below the top surface 11*a* so as to extend substantially in parallel thereto. A control device such as a control board can be placed in a space 39 below the sheet storage portion 30 of the case 11. A space for storing a battery 35 is provided at a lower corner of the space 39.

The printing mechanism 20 includes a pick-up roller 13 for picking up a thermal printing sheet 1 from the sheet storage portion 30, a thermal head 15 serving as a printing head capable of thermally recording data on the thermal sheet 1, and a platen roller 14 having a sheet feeding function. The pick-up roller 13, the thermal head 15 and the platen roller 14 are sequentially arranged in this order from the sheet storage portion 30. The pick-up roller 13 and the thermal head 15 are further arranged so as to be partially vertically overlapped. The thermal sheet 1 accommodated in the sheet storage portion 30 is picked up by the pick-up roller 13 and guided into a printing portion 15*b* of the thermal head 15, which is in contact with the platen roller 14. Then, the printed thermal sheet 1 is guided into the exit slot (feed out port) 17 by the platen roller 14 for feeding out. The number of components of the printing mechanism for printing on the thermal sheet 1 can be reduced. In the present embodiment, as the thermal head 15 and the platen roller 14 can be arranged along the sheet feeding direction, the resultant printing mechanism 20 can be formed into a thin and compact structure. Since the thermal sheet 1 is thin and allows to change the sheet feeding direction easily, the direction of feeding out the sheet can be easily changed to the top surface 11*a* using the platen roller 14 having a small diameter even in the limited space. In the thin and substantially rectangular-shaped case 11, the printing mechanism 20 and the sheet storage portion 30 are arranged close together along the top surface 11*a*. As a result, the printer 10 can be designed and assembled into a thin and a flat structure.

Moreover, according to the printer 10 of the present embodiment, a driving motor 18 is provided within the platen roller 14. The motor 18 can rotate each of the platen roller 14 and the pick-up roller 13 rotated in an appropriate direction through an appropriate power transmission mechanism like a gear string. Therefore, the space that required for housing the motor is saved, resulting in further compact printing mechanism 20.

In the printing mechanism 20 of the present embodiment, the printing portion 15*b* of the thermal head 15 faces on the lower side (opposite to the top surface 11*a*) of the platen roller 14. The printed thermal sheet 1 is fed along the platen roller 14 into the exit port 17 formed in the top surface 11*a* for feeding out. Hence, the printed thermal sheet 1 is fed out onto the top surface 11*a* with its printed surface la directed upside. Therefore, the user can confirm the printed result immediately.

The rotating direction of the pick-up roller 13 can be selected by changing the rotating direction of the motor 18. The pick-up roller 13 is rotated toward the platen roller 14 for sheet feeding. Upon start of printing, the pick-up roller 13 is rotated reversely such that a thermal sheet 1 is individually guided between the thermal head 15 and the platen roller 14.

The sheet storage portion 30 contains a cassette-like (cartridge) sheet storage space 5 formed along a back side of the top surface 11*a* of the case 11 so as to accommodate a plurality of thermal sheets of standardized size. A portion of the top surface 11*a* of the case 11 for covering the space 5 functions as a cover 8 that can open and close the space 5. The cover 8 is attached to the case 11 at its short side opposite to the one adjacent to the exit slot 17 using a hinge 9 so as to be pivotally rotated with respect to the case 11 for opening and closing operation.

Figure 4:
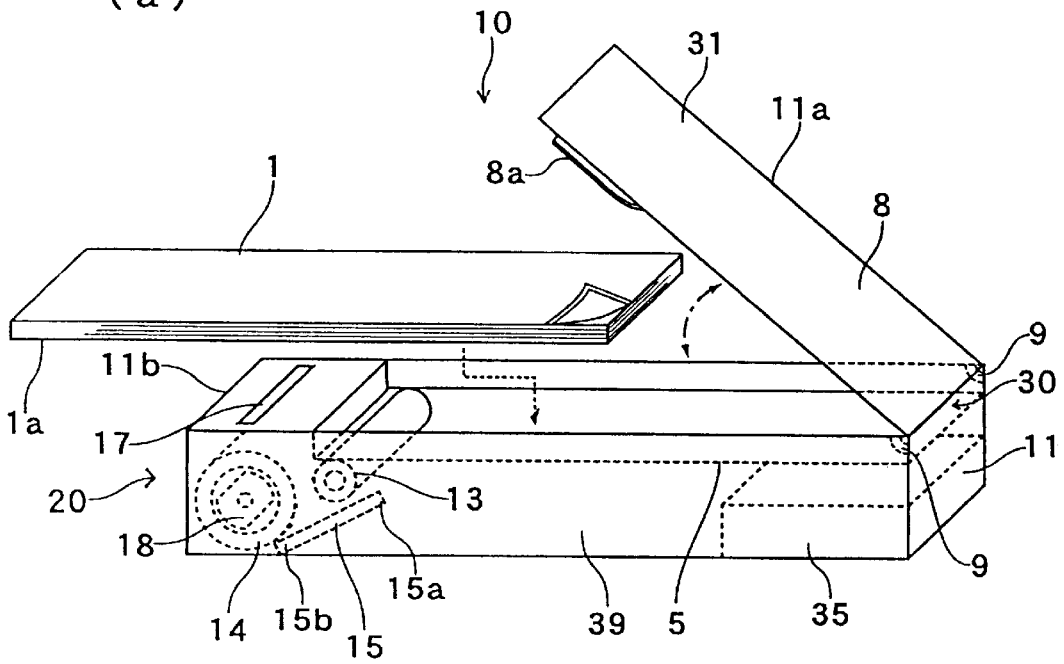
FIG. 4 is a diagram illustrating how the printing sheets are stored in the printer shown in FIG. 1.
Figure 4:
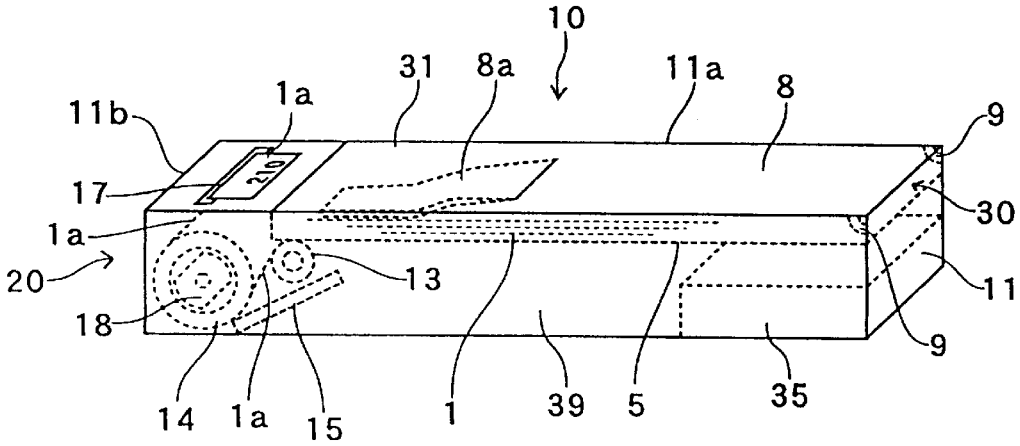

As shown in FIG. 4(*a*), the cover 8 can be raised upward from the main body of the printer 10. The thermal sheet 1 can be supplied to the storage space 5 while opening the cover 8. The thermal sheet 1 can be set in the storage space 5 with its printing surface 1*a* directed downside (face down) such that the thermal sheet 1 is fed with its printing surface 1*a* facing the thermal head 15. The sheets accommodated in this style are fed out through the exit port 17 with the printed surface 1*a* directed upside. After setting the thermal sheet 1 in the storage space 5, the cover 8 is closed as shown in FIG. 4(*b*). Since a spring sheet-pressing member 8*a* is provided on the back surface of the cover 8 which faces the storage space 5, the thermal sheet 1 is pressed against the pick-up roller 13 by the sheet-pressing member 8*a*. Accordingly, all thermal sheets 1 can be smoothly and completely fed into the printing mechanism 20 piece by piece.

When the cover 8 is closed, the sheet storage portion 30 is tightly sealed. Therefore the thermal printing sheet 1 can be protected from being exposed to light-ray, heat, dust and the like. In the printer 10 of the present embodiment, the top surface 11*a* serving as the cover 8 is also used as a tray on which the printed sheet fed out through the exit slot 17 is placed, allowing no device to be placed thereon. Therefore thermal sheets will always be easily supplied to the printer 10.

The printer 10 of the present embodiment accommodates the thermal sheet of standardized size in the cartridge-type sheet storage portion 30 and has the compact thermal printing mechanism 20 provided adjacent to one end of the sheet storage portion 30, resulting in a thin and compact structure. Moreover, the cassette-like sheet storage space 5 has a size suitable for accommodating sheets of size smaller than those for popular printers. More specifically, the printer 10 of the present embodiment uses the printing sheet of size A6 (widths about 105 mm, length; about 148 mm) or B7 (width: about 91 mm, length: about 128 mm) which is smaller than the size A4 (width; about 210 mm, length: about 297 mm) or letter size used in almost all the printers on the market. Accordingly, the case 11, i.e., the printer 10, can be formed into a thin and compact structure as small as a notebook such as a memo pad.

Aforementioned, the printer 10 of the present embodiment uses the thermal sheet 1 of standard size such as A6 or B7 which is smaller than A4-size sheet used in the general printers. The above-sized printing sheet is sufficient to print data of e-mail or the browser. Therefore, the printer of the present embodiment provides sufficient functions as a printer for personal use. Moreover, unlike the conventional compact size printer using roll-type thermal paper, the printer 10 of the present embodiment uses the thermal sheet 1 of standardized size that is cut sheet and fed with piece by piece. Therefore, elements for sheet feeding function do not have to be as accurate as those used in the general compact printer. More specifically, in the case of using the roll-type paper, it is likely to be displaced little by little from the original feeding position. The slight displacement amount will be accumulated accompanied with the progress of printing, which might cause paper jam. Meanwhile in the case of using the sheet of standardized size, it can be fed piece by piece. Therefore as the sheet displacement will not occur, the printer becomes inexpensive and hardly causes paper jam.

Since the printer 10 of the present embodiment uses the thermal sheet 1, printing can be performed without using expendable and/or consumable supplies, for example, ink, ribbon or toner. As the space for accommodating such expendable supplies is not required, the printing mechanism 20 can be formed into a compact structure. Moreover, since the printer 10 uses the thermal sheet 1 of standardized size that is thin and not rolled, sufficient amount of printing sheets can be accommodated in a thin storage space 5. The use of the printing sheet as small as A6 or B7 may form the printer itself into a thin and compact structure. The printing mechanism 20 and the sheet storage portion 30 are arranged on a horizontal plane so as not to be overlapped. The printing mechanism 20 and the sheet storage portion 30 can be accommodated within the thin, flat case 11, thus reducing the overall size of the printer to be as small as that of the stationery like a small notebook or a pencil case on the desk. Therefore, the printer can be easily set aside the personal computer without requiring the extra desktop space for the printer.

The printer 10 of the present invention is small and thin, and therefore, is easy to carry. The printer 10 can be easily carried with the user from the office to home or vice versa and even for the occasion of business trip together with a portable data processor such as a PDA (Personal Data Acquisition/Personal Digital Assistance) and a notebook-sized computer.

With the printer 10 of the present embodiment, the printed sheet is fed out onto the flat top surface 11*a* of the case 11. Therefore, the user is allowed to easily write down any comments or notes on the printed sheet placed on the flat top surface 11*a*. Thus, the printer 10 can be used as a small notebook or a memo pad. Moreover the printing sheets of standard size can be easily filed.

The printer 10 with small and simple structure can be provided as an inexpensive printer for the user. Therefore they can be handy not only in the office but also at home as the personal use printer.

Furthermore, since the printer 10 of the present embodiment can be operated using only small-sized thermal sheet such as B7, the load exerted to the motor is relatively low. Therefore a single motor is sufficient to drive the entire printer 10, thus reducing power consumption. This allows the battery space 35 to be incorporated within the space below the sheet storage portion 30 for sufficient driving, which eliminates the additional power source and wiring. The printer of this embodiment, thus, can be considered to be suitable for the desktop printer.

Although the printer 10 has a rectangular shape having a small thickness in the present embodiment, its shape is not limited to the aforementioned shape. It may take various shapes such as a polygon, circle or oval. Therefore the printer can be freely designed as the stationary. As the thermal sheet can be printed in multi colors, such as red and black, the printer 10 is allowed to perform color printing as well as monochrome printing.

Although the cover 8 is pivotally opened and closed in this embodiment, the present invention is not limited to the aforementioned structure. Alternatively the cover of sliding type may be employed. Moreover in the present embodiment, the sheet accommodating portion 30 may be structured to contain a paper-cartridge or a plastic-cartridge in which a plurality of printing sheets are already packaged.

As has been described above, according to the printer of the present invention, the printing mechanism and the sheet storage portion capable of accommodating a plurality of sheets of standard size such as A6 or B7 are arranged within the thin case along the top surface thereof, and the printed sheet is fed out onto the top surface of the flat case, thus requiring only a small space for the printer. As a result, an inexpensive, thin, compact printer which can be used as handy as a memo pad can be provided.

Various other modifications will be apparent to and can be readily made by those skilled in the art without departing from the scope and spirit of this invention.

What is claimed is:

1. A printer comprising:

a flat case with an openable cover having substantially a flat top surface and a sheet pressing member, the case housing a printing mechanism and a sheet storage portion for accommodating a plurality of printing sheets along the top surface, the sheet storage portion having first and second ends, the printing mechanism having a pick-up roller for picking up a thermal sheet from the sheet storage portion, a platen roller for feeding the thermal sheet, and a thermal head for printing on the thermal sheet, the printing mechanism and the sheet storage portion being arranged along the top surface such that said sheet storage portion is covered by said cover, the pick-up roller being adjacent said sheet storage portion and below said sheet pressing member of the cover, said sheet pressing member pressing said sheet against said pick-up roller when said cover is closed; and an exit slot formed in the top surface of the case for feeding out the sheet after printing, said printing mechanism, including the pick-up roller, the sheet pressing member and the exit slot being located adjacent the first end of the sheet storage portion; the path of travel of the sheet from the pick-up roller passing about the platen roller to the exit slot, the entire path of travel of the sheet, from the pick-up roller to the exit slot, being located at the first end of the sheet storage portion.

2. A printer according to claim 1, wherein said sheet storage portion has a size suitable for accommodating a plurality of printing sheets of standard size of either A6 or B7.

3. A printer according to claim 1, wherein a plurality of printing sheets are set in said sheet storage portion with each printing surface directed downside, and are fed out with each printing surface directed upside from said exit slot.

4. A printer according to claim 1, wherein the top surface of said case is used as a tray on which fed printed sheet is placed.

5. A printer comprising a case with a top and an openable cover having a flat upper surface, the case housing a thermal printing mechanism and a sheet storage portion, the sheet storage portion accommodating a plurality of cut thermal printing sheets beneath the flat upper surface of the cover, the sheet storage portion having first and second ends, the printing mechanism having a pick-up roller for picking up a thermal sheet from the sheet storage portion, a platen roller for feeding the thermal sheet, and a thermal head for printing on the thermal sheet, the printing mechanism being located adjacent the first end of the sheet storage portion, the pick-up roller being located beneath the sheet storage portion for picking up a lowermost thermal sheet from the plurality of sheets in the sheet storage portion, and an exit slot formed in the top of the case adjacent the first end of the sheet storage portion for feeding out the thermal sheet after printing onto the flat upper surface of the cover; the path of travel of the sheet from the pick-up roller passing about the platen roller to the exit slot, the entire path of travel of the sheet, from the pick-up roller to the exit slot, being located at the first end of the sheet storage portion.

6. The printer of claim 5, including a sheet pressing member attached to the cover for pressing the printing sheets against the pick-up roller.

7. The printer of claim 5, wherein the pick-up roller and the thermal print head are located below the sheet storage portion at the first end of the case.

8. The printer of claim 5, wherein the top of the case is flat and comprises the flat upper surface of the cover.

9. A printer comprising a flat case having a top and bottom and first and second ends, the case housing a printing mechanism at the first end of the case and a sheet storage portion at the second end of the case in substantially end-to-end relation with the printing mechanism, the case having an openable cover pivotally connected at the second end of the case, the cover having a substantially flat upper surface, the sheet storage portion accommodating a stack of printing sheets located beneath the cover, the printing mechanism having a pick-up roller for picking up a printing sheet from the sheet storage portion, a platen roller for feeding the printing sheet, and a print head for printing on the printing sheet, the pick-up roller being located beneath the sheet storage portion so as to pick up a lowermost printing sheet from the stack of sheets in the sheet storage portion, and an exit slot formed in the top of the case at the first end of the case for feeding out the printing sheet after printing onto the flat upper surface of the cover in a direction from the first end to the second end; the path of travel of the sheet from the pick-up roller passing about the platen roller to the exit slot, the entire path of travel of the sheet, from the pick-up roller to the exit slot, being located at the first end of the sheet storage portion.

10. The printer of claim 9, wherein the printing mechanism is a thermal print mechanism and the printing sheets are cut thermal printing sheets.

11. The printer of claim 9, including a sheet pressing member attached to the cover for pressing the printing sheets against the pick-up roller.

12. The printer of claim 9, wherein the pick-up roller, the platen roller and the print head are located at the first end of the case below the sheet storage portion.

13. The printer according to claim 1, comprising non-paper-feeding components mounted inside the case adjacent a bottom of the case.

14. The printer according to claim 5, comprising non-paper-feeding components mounted inside the case adjacent a bottom of the case.

15. The printer according to claim 9, comprising non-paper-feeding components mounted inside the case adjacent the bottom of the case.

* * * * *